US008330674B2

(12) United States Patent
Imai et al.

(10) Patent No.: US 8,330,674 B2
(45) Date of Patent: Dec. 11, 2012

(54) MULTIPLEX IMAGE DISPLAY DEVICE, MULTIPLEX IMAGE DISPLAY COMPUTER PROGRAM, AND COMPUTER-READABLE STORAGE MEDIUM CONTAINING THE PROGRAM

(75) Inventors: Akira Imai, Nara (JP); Tomoo Takatani, Nara (JP); Yoshihide Koyama, Matsusaka (JP); Hiroshi Fukushima, Yamatokoriyama (JP); Koji Yabuta, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 850 days.

(21) Appl. No.: 11/908,177

(22) PCT Filed: Mar. 7, 2006

(86) PCT No.: PCT/JP2006/304392

§ 371 (c)(1),
(2), (4) Date: Sep. 10, 2007

(87) PCT Pub. No.: WO2006/100904

PCT Pub. Date: Sep. 28, 2006

(65) Prior Publication Data

US 2009/0225002 A1 Sep. 10, 2009

(30) Foreign Application Priority Data

Mar. 18, 2005 (JP) ..... 2005-080546

(51) Int. Cl.
*G09G 5/00* (2006.01)

(52) U.S. Cl. ..... 345/9

(58) Field of Classification Search ..... 345/1.1, 345/1.2, 1.3, 100–102, 204, 9, 156
See application file for complete search history.

(56) References Cited

U.S. PATENT DOCUMENTS

| | | | | |
|---|---|---|---|---|
| 5,745,096 | A * | 4/1998 | Ludolph et al. | 715/764 |
| 5,926,154 | A | 7/1999 | Hirono et al. | |
| 5,936,596 | A * | 8/1999 | Yoshida et al. | 345/9 |
| 6,684,110 | B1 | 1/2004 | Kutsuna et al. | |
| 6,788,319 | B2 * | 9/2004 | Matsumoto et al. | 715/841 |
| 2002/0186212 | A1 * | 12/2002 | Matsumoto et al. | 345/204 |

(Continued)

FOREIGN PATENT DOCUMENTS

JP 62-057392 A 3/1987

(Continued)

OTHER PUBLICATIONS

Official Communication issued in the International Application No. PCT/JP2006/304392, mailed on Apr. 4, 2006.

*Primary Examiner* — Quan-Zhen Wang
*Assistant Examiner* — Calvin C Ma
(74) *Attorney, Agent, or Firm* — Keating & Bennett, LLP

(57) ABSTRACT

A multiplex image display device prevents onscreen input buttons from appearing at the same positions. A "command area" refers to an area of the display screen where the user can enter a command for manipulating one of images being simultaneously displayed on the single display section for individual viewing from different directions. In the multiplex image display device, the positioning control section controls the positioning of the command areas so that a command area for one of the images being simultaneously displayed on the display section is displayed at a different (i.e., non-overlapping) position on the display section from a command area for another one of such images.

10 Claims, 8 Drawing Sheets

U.S. PATENT DOCUMENTS

| | | | | |
|---|---|---|---|---|
| 2003/0007227 | A1* | 1/2003 | Ogino | 359/227 |
| 2004/0119896 | A1 | 6/2004 | Kean et al. | |
| 2006/0066507 | A1 | 3/2006 | Yanagisawa | |
| 2006/0279528 | A1 | 12/2006 | Schobben et al. | |
| 2008/0068284 | A1 | 3/2008 | Watanabe et al. | |

FOREIGN PATENT DOCUMENTS

| | | | |
|---|---|---|---|
| JP | 63-182632 | A | 7/1988 |
| JP | 03-230699 | A | 10/1991 |
| JP | 05-216607 | A | 8/1993 |
| JP | 05-307162 | A | 11/1993 |
| JP | 06-195049 | A | 7/1994 |
| JP | 06-236152 | A | 8/1994 |
| JP | 08-137447 | A | 5/1996 |
| JP | 09-171434 | A | 6/1997 |
| JP | 2000-137443 | A | 5/2000 |
| JP | 2001-024685 | A | 1/2001 |
| JP | 2005-071286 | A | 3/2005 |
| JP | 2006-091645 | A | 4/2006 |
| JP | 2006-151363 | A | 6/2006 |
| JP | 2006-522397 | A | 9/2006 |
| WO | 2004/081777 | A1 | 9/2004 |

* cited by examiner

FIG. 8

| | | | | |
|---|---|---|---|---|
| A | A | A | A | A |
| A | A | A | A | A |
| A | A | A | A | A |
| B | B | B | B | B |
| B | B | B | B | B |
| B | B | B | B | B |

FIG. 9

| | | | | |
|---|---|---|---|---|
| A | B | A | B | A |
| A | B | A | B | A |
| A | B | A | B | A |
| A | B | A | B | A |
| A | B | A | B | A |
| A | B | A | B | A |

FIG. 10

| | | | | |
|---|---|---|---|---|
| A | B | A | B | A |
| B | A | B | A | B |
| A | B | A | B | A |
| B | A | B | A | B |
| A | B | A | B | A |
| B | A | B | A | B |

FIG. 11

| | | | | |
|---|---|---|---|---|
| A | A | A | A | A |
| A | B | B | B | A |
| A | B | B | B | A |
| A | B | B | B | A |
| A | B | B | B | A |
| A | A | A | A | A |

| | | | | |
|---|---|---|---|---|
| A | A | A | A | A |
| A | A | A | A | A |
| | | | | |
| | | | | |
| | | | | |
| | | | | |

| | | | | |
|---|---|---|---|---|
| A | A | A | A | A |
| A | A | A | A | A |
| | | | | |
| | | | | |
| | | | | |
| B | B | B | B | B |

| | | | | |
|---|---|---|---|---|
| A | A | A | A | A |
| A | A | A | A | A |
| Common Area | Common Area | Common Area | Common Area | Common Area |
| Common Area | Common Area | Common Area | Common Area | Common Area |
| B | B | B | B | B |
| B | B | B | B | B |

MULTIPLEX IMAGE DISPLAY DEVICE, MULTIPLEX IMAGE DISPLAY COMPUTER PROGRAM, AND COMPUTER-READABLE STORAGE MEDIUM CONTAINING THE PROGRAM

BACKGROUND OF THE INVENTION

1. Field of the Invention

The present invention relates to multiplex image display devices, including a display section equipped with an information input device, which is capable of producing different image displays for different viewing points. The present invention also relates to multiplex image display computer programs and computer-readable storage media containing those programs.

2. Description of the Related Art

Multiplex image display devices with onscreen input functions have been popularly used and include a display section equipped with an information input device and are capable of displaying different images for different viewing points.

A dual view display device is a type of multiplex image display device which is capable of producing different displays for the right and left on a single display screen. Such devices are described, for example, in Patent Documents 1 to 9. One of them is a combination of a display device (e.g., LCD) and a touch panel (information input devices provided on the display section).

An example of a dual view display is shown in FIG. 16, where the screen shows a car navigation image when viewed from the right and a DVD replay from the left.

Patent Document 1 Japanese Unexamined Patent Publication 62-57392/1987 (Tokukaisho 62-57392; published Mar. 13, 1987)

Patent Document 2 Japanese Unexamined Patent Publication 63-182632/1988 (Tokukaisho 63-182632; published Jul. 27, 1988)

Patent Document 3 Japanese Unexamined Patent Publication 3-230699/1991 (Tokukaihei 3-230699; published Oct. 14, 1991)

Patent Document 4 Japanese Unexamined Patent Publication 6-195049/1994 (Tokukaihei 6-195049; published Jul. 15, 1994)

Patent Document 5 Japanese Patent 3133478 (issued Feb. 5, 2001)

Patent Document 6 Japanese Patent 3398999 (issued Apr. 21, 2003)

Patent Document 7 Japanese Patent 3184069 (issued Jul. 9, 2001)

Patent Document 8 Japanese Unexamined Patent Publication (Tokukai) 2000-137443 (published May 16, 2000)

Patent Document 9 Japanese Unexamined Patent Publication (Tokukai) 2004-206089 (published Jul. 22, 2004)

A problem of the combination of a multiplex image display device and an information input device (a dual view display device and a touch panel) is that input buttons may appear at the same position on screen.

See FIG. 17. The duel view display includes a right-side image 71 when viewed from the right and a left-side image 72 when viewed from the left. The right-side image 71 consists of a right-side main image 71*a* and right-side input buttons 71*b*, 71*c*, 71*d*, 71*e*. The left-side image 72 consists of a left-side main image 72*a* and left-side input buttons 72*b*, 72*c*, 72*d*, 72*e*. Both the right-side input buttons and the left-side input buttons appear on the lowest part of the screen. That is, they appear at the same position. In this situation, the multiplex image display device is unable to determine correctly which input button is pressed.

SUMMARY OF THE INVENTION

In order to overcome the problems described above, preferred embodiments of the present invention provide a multiplex image display device, a multiplex image display computer program, and a computer-readable storage medium containing the program, all of which prevent onscreen input buttons (and any other "command area" which is an area of a display screen where the user can enter a command for manipulating an image) from appearing at the same positions.

To solve the problems with prior art described above, the multiplex image display device in accordance with a preferred embodiment of the present invention is characterized as follows. The device simultaneously displays a plurality of images on a single display screen for individual viewing from different directions. The device includes a positioning control section for controlling positioning of onscreen command areas where a user can enter a command for manipulating one of the images. The positioning is controlled such that when a command area for one of the images is displayed simultaneously with a command area for another one of the images, these command areas are displayed at different positions on the same display screen.

The configuration enables the multiplex image display device to control the positioning of the onscreen command areas where the user can enter a command for manipulating one of the images being simultaneously displayed on a single display screen for individual viewing from different directions, so that when a command area for one of the images is displayed simultaneously with a command area for another one of the images, these command areas are displayed at different (i.e., non-overlapping) positions on the same display screen.

Therefore, no command area for manipulating one image is a command area for another image being simultaneously displayed. Therefore, onscreen input buttons (and any other "command area" which is an area of the display screen where the user can enter a command for manipulating an image) are prevented from appearing at the same positions.

As described in the foregoing, the multiplex image display device in accordance with a preferred embodiment of the present invention is configured to include a positioning control section for controlling the positioning of onscreen command areas where the user can enter a command for manipulating one of images being simultaneously displayed on a single display screen. The positioning is controlled such that when a command area for one of the images is displayed simultaneously with a command area for another one of the images, these command areas are displayed at different positions on the same display screen.

Accordingly, no command area for manipulating one image is a command area for another image being simultaneously displayed. Therefore, onscreen input buttons (and any other "command area" which is an area of the display screen where the user can enter a command for manipulating an image) are prevented from appearing at the same positions.

These and additional novel elements, steps, characteristics, and advantages of the present invention will be set forth in part in the description of preferred embodiments thereof which follows, and in part will become apparent to those skilled in the art upon examination of the following or may be learned by practice of various preferred embodiments of the present invention.

BRIEF DESCRIPTION OF DRAWINGS

FIG. 8 is an illustration of an example of allocation of areas for image displays.

FIG. 9 is an illustration of an example of allocation of areas for image displays.

FIG. 10 is an illustration of an example of allocation of areas for image displays.

FIG. 11 is an illustration of an example of allocation of areas for image displays.

DETAILED DESCRIPTION OF PREFERRED EMBODIMENTS

Preferred embodiments of the present invention provide a multiplex image display device that produces more than one image display simultaneously on a single display screen for individual viewing from different directions, and here, especially, a double image display device (dual view display device) which displays different images when viewed from the right and left of the display screen. The image display as viewed from the right will be referred to as image A, the image display as viewed from the left as image B.

A user interface is provided in the form of onscreen command areas where the user can enter commands for manipulating an image. An example of the area is an input button the user can "press" by clicking it or otherwise pointing at it. The area is not necessarily an input button which responds to a "press" action; it may be a slide bar which responds to a sliding action. The onscreen input function is preferably provided by a touch panel.

The present invention is applicable to pointing devices (mice, track balls, etc.) as well as to touch panels.

The multiplex image display device may be a publicly known dual view LCD.

This configuration may be used for a dual view LCD equipped with a touch panel, which is a hugely popular in-vehicle product. The LCD, for example, displays a car navigation for the driver and a television and DVD control for the assistant driver.

The multiplex image display device configured as described above includes a touch panel both acting as a display screen for the dual view LCD and providing input areas in the form of the command areas. A CPU (central processing unit) runs multiplex image display software in response to a user command, thereby implementing a multiplex image display (multiplex image display program). The device operates under the control of the CPU. Details will be discussed later.

The multiplex image display software and that software which provides images for display on the screen under a GUI (graphical user interface) program will be hereinafter referred to simply as applications. Examples include DVD replay programs, car navigation programs, television display programs, game programs, control programs for air conditioners, IT devices, etc. These applications may be installed into the multiplex image display device by the user if necessary or pre-installed in the multiplex image display device as part of its function.

The GUI detects which onscreen input button is pressed and communicates, to an application, which function is selected (requested). The application is informed, by the GUI, which function is selected.

Figure 1:
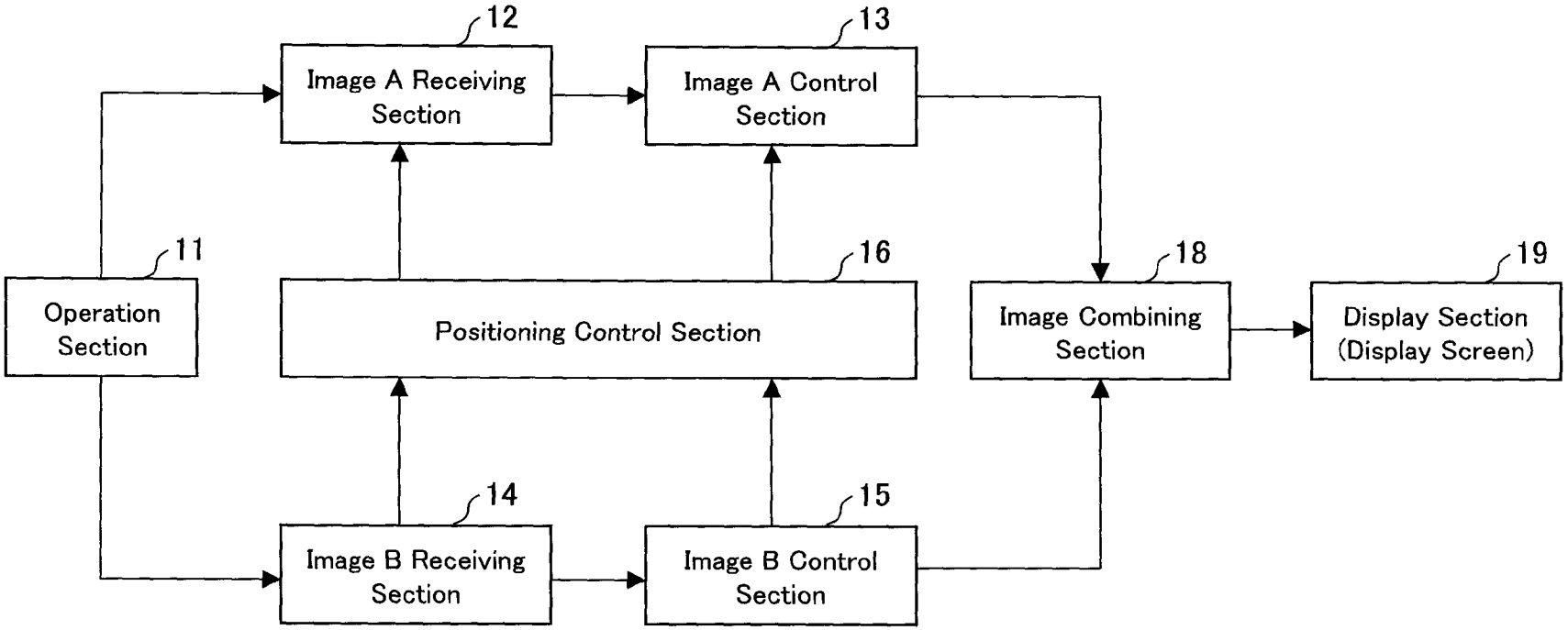
FIG. 1 is a block diagram illustrating an example of the structure of a multiplex image display device in accordance with a preferred embodiment of the present invention.

Now, referring to FIG. 1, the multiplex image display device includes an operation section 11, an image A receiving section 12, an image A control section 13, an image B receiving section 14, an image B control section 15, a positioning control section 16, an image combining section 18, and a display section 19. The image A receiving section 12, the image A control section 13, the image B receiving section 14, the image B control section 15, the positioning control section 16, and the image combining section 18 are function modules realized by the CPU running the multiplex image display software. The positioning control section 16 produces a multiplex image display. The image A control section 13 and the image B control section 15 provide the GUI. The operation section 11 enables the user to select an application and turn on/off a power supply, for example. The display section 19 provides a display screen.

In the multiplex image display device according to a preferred embodiment of the present invention, when a command area for one of the images being simultaneously displayed on the display section 19 is displayed simultaneously with a command area for another one of such images, the positioning control section 16 controls the positioning of the command areas so that the two command areas are displayed at different (i.e., non-overlapping) positions on the same display section 19. A "command area" refers to an area of the display screen where the user can enter a command for manipulating one of the images being simultaneously displayed on the single display section 19 for individual viewing from different directions. Therefore, the device prevents onscreen input buttons (and any other "command area" which is an area of the display screen where the user can enter a command for manipulating an image) from appearing at the same positions. Accordingly, user commands are correctly communicated to the multiplex image display device from each screen image.

This structure allows the user to select from options for the process. For example, overlapping of the command areas may be detected first before repositioning. Alternatively, the positions of the command areas may be pre-adjusted so that they do not overlap. Other options include adjusting the positions after the command areas are displayed or determining the positions every time a request is made by an application. Also, any of the options may be combined. The following will describe these options one by one.

First will be described the detecting of a command area overlap and subsequent repositioning.

As mentioned earlier, if a touch panel input position (hereinafter, "input button") on one image overlaps a touch panel input position on another image, the touch panel does not function correctly.

Figure 2:
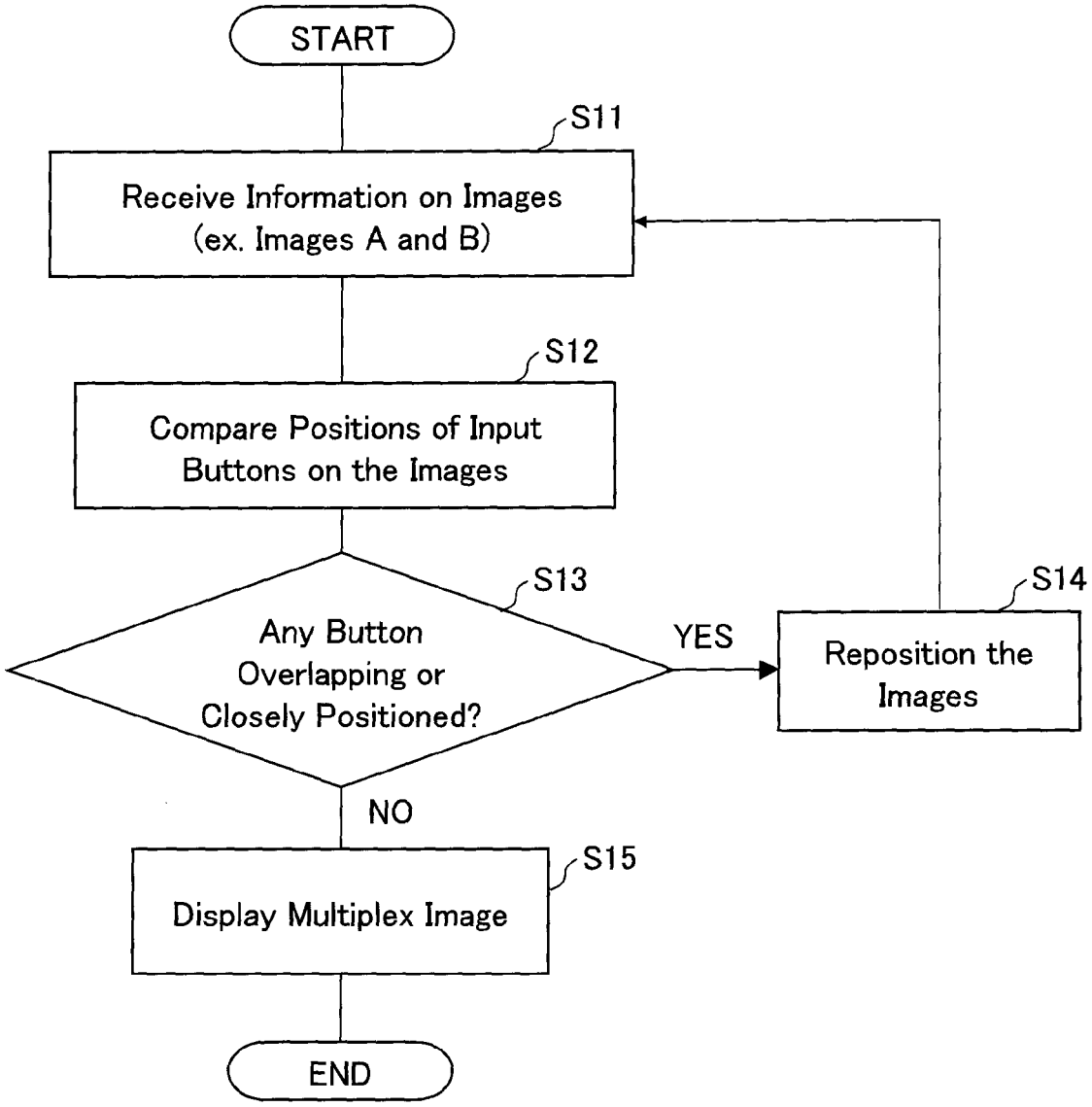
FIG. 2 is a flow chart illustrating a multiplex image display process implemented by the multiplex image display device in accordance with a preferred embodiment of the present invention.

To prevent this from happening with a dual view display, as the user selects applications on the operation section 11, the image A receiving section 12 and the image B receiving section 14 receive two images from the respective applications (S11). See FIG. 2. Then, the positioning control section 16 compares the positions of the input buttons for the two images (S12) and checks if there is an overlap of the input button positions (S13).

If the input button positions are the same or too close, the images are repositioned (S14). Image positioning is to issue instructions to the GUI on the positions of the input buttons. The threshold of being "too close and "sufficiently distanced" may be preset either by the user or by the multiplex image display device. The settings may be given in pixel count or inches, for example. The image A control section 13 and the image B control section 15, if they receive a repositioning instruction, produce data for the images with repositioned input buttons according to the instruction, and otherwise produce standard (default) image data. The image combining section 18 combines the two images according to a publicly known method specified for the double image display device. The display section 19 displays the combined image.

If the positions are neither the same nor too close, the display section 19 displays an unmodified multiplex image (S15).

Screen images in this situation are shown in FIGS. 3 to 6.

Figure 3:
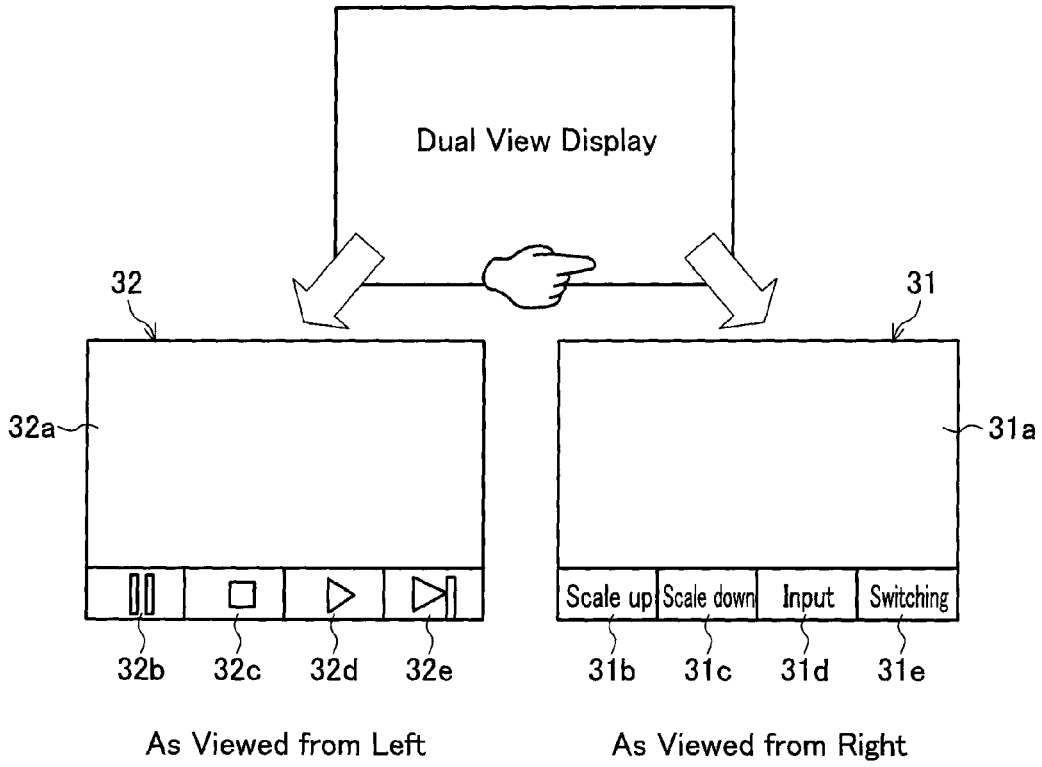
FIG. 3 is an illustration of overlapping onscreen input areas before repositioning.

FIG. 3 shows a case which involves no repositioning. A right-side image 31 (image A) is viewable from the right. The right-side image 31 includes a right-side main image 31*a* and right-side input buttons 31*b*, 31*c*, 31*d*, 31*e*. A left-side image 32 (image B) is viewable from the left. The left-side image 32 includes a left-side main image 32*a* and left-side input buttons 32*b*, 32*c*, 32*d*, 32*e*. The main image refers to the non-input button portions of the image, that is, those areas which are unaffected by user commands: it is the broadcast image for television and the replayed image for a DVD, for example.

Figure 4:
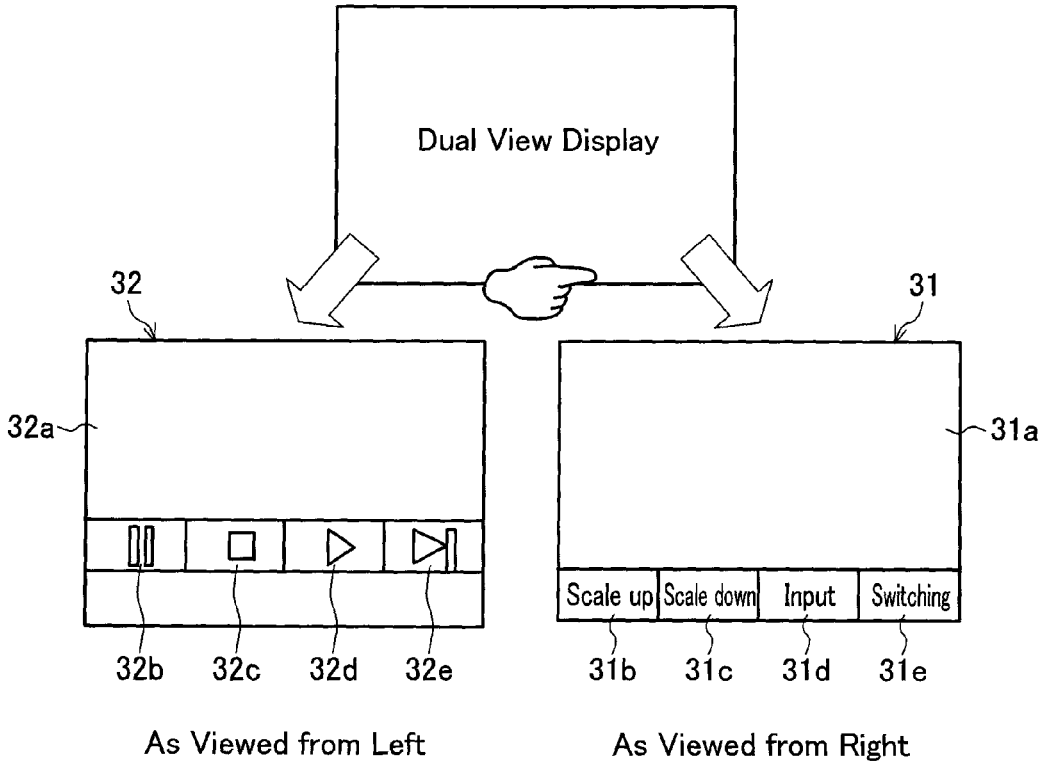
FIG. 4 is an illustration of overlapping onscreen input areas after repositioning.

FIG. 4 shows the same right-side image as FIG. 3. Meanwhile, the left-side image differs where the left-side input buttons are all moved up on the screen so that they do not appear at the same positions as the right-side input buttons.

Figure 5:
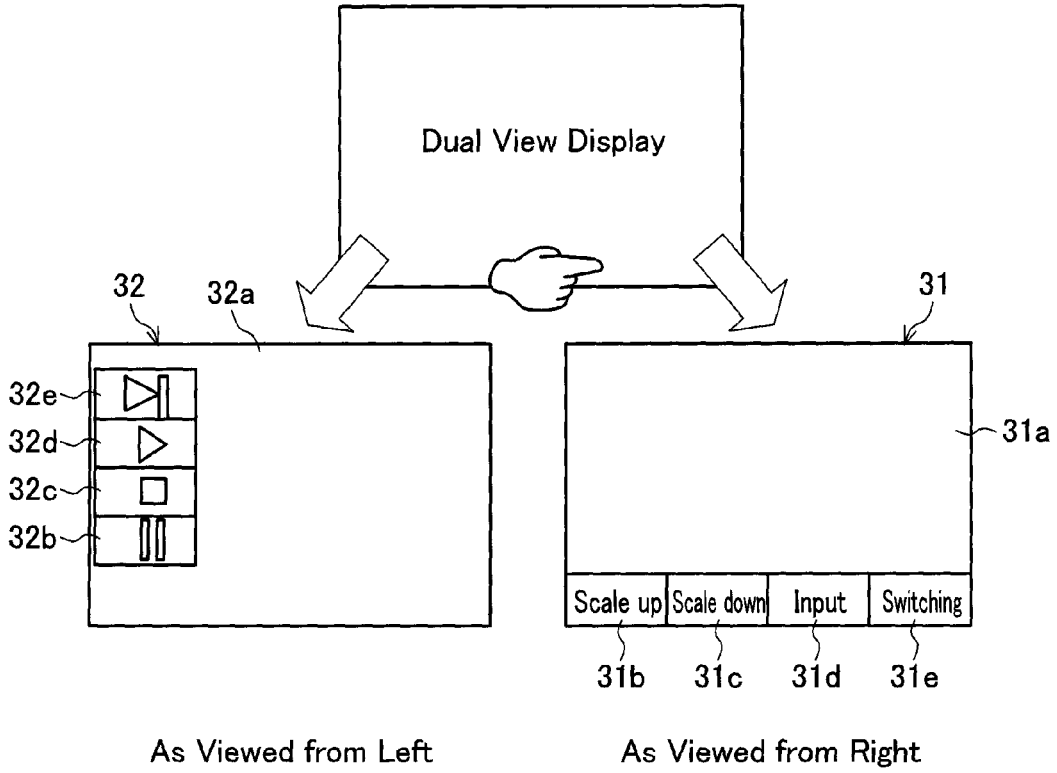
FIG. 5 is an illustration of overlapping onscreen input areas after repositioning.

FIG. 5 shows the same right-side image as FIG. 3. Meanwhile, the left-side image differs where the left-side input buttons are all stacked along the left-hand side of the screen so that they do not appear at the same positions as the right-side input buttons.

Some of the input buttons may be grouped together and moved as in FIGS. 4 and 5.

Figure 6:
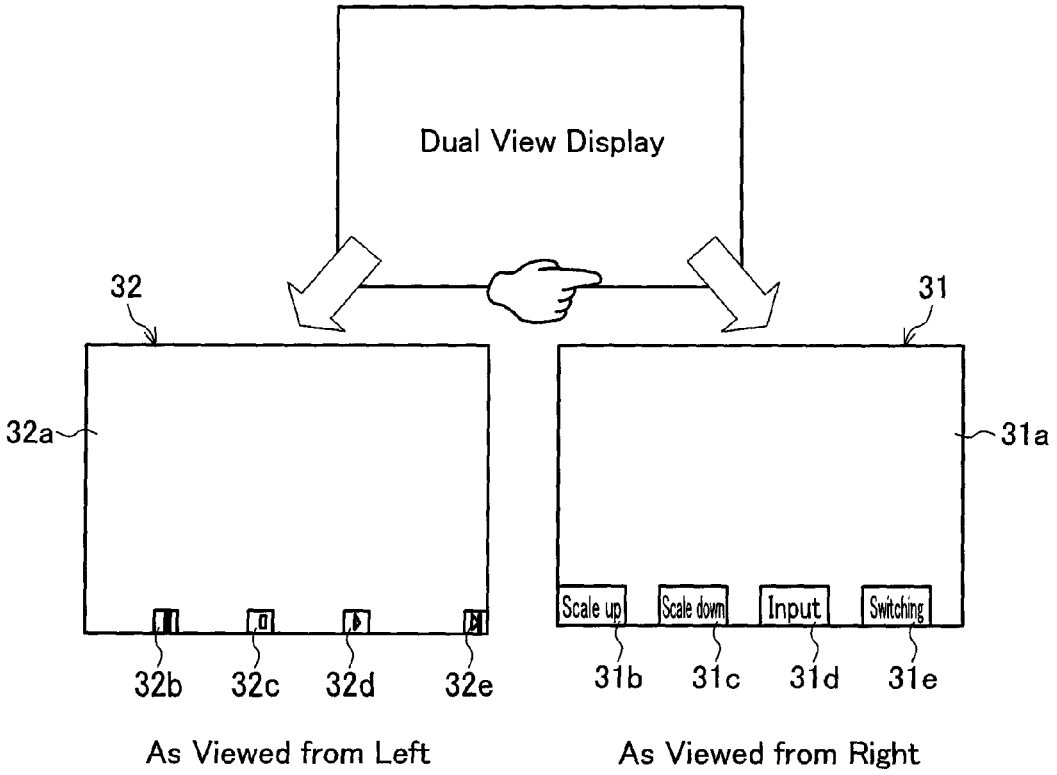
FIG. 6 is an illustration of overlapping onscreen input areas after repositioning.

The right-side image and the left-side image in FIG. 6 both show changes from those in FIG. 3. All the input buttons are reduced in size so that corresponding buttons do not overlap.

Common input buttons, for example, a switching button for dual and single views, may appear at the same positions.

When one of the screen images is showing a navigation, input buttons may appear on a map on screen. The input buttons on the other display image are preferably clustered in or near a corner.

There may be a spacing or no spacing between adjacent input buttons. Preferably, a spacing (non-input area) is provided to reduce input errors.

Figure 7:
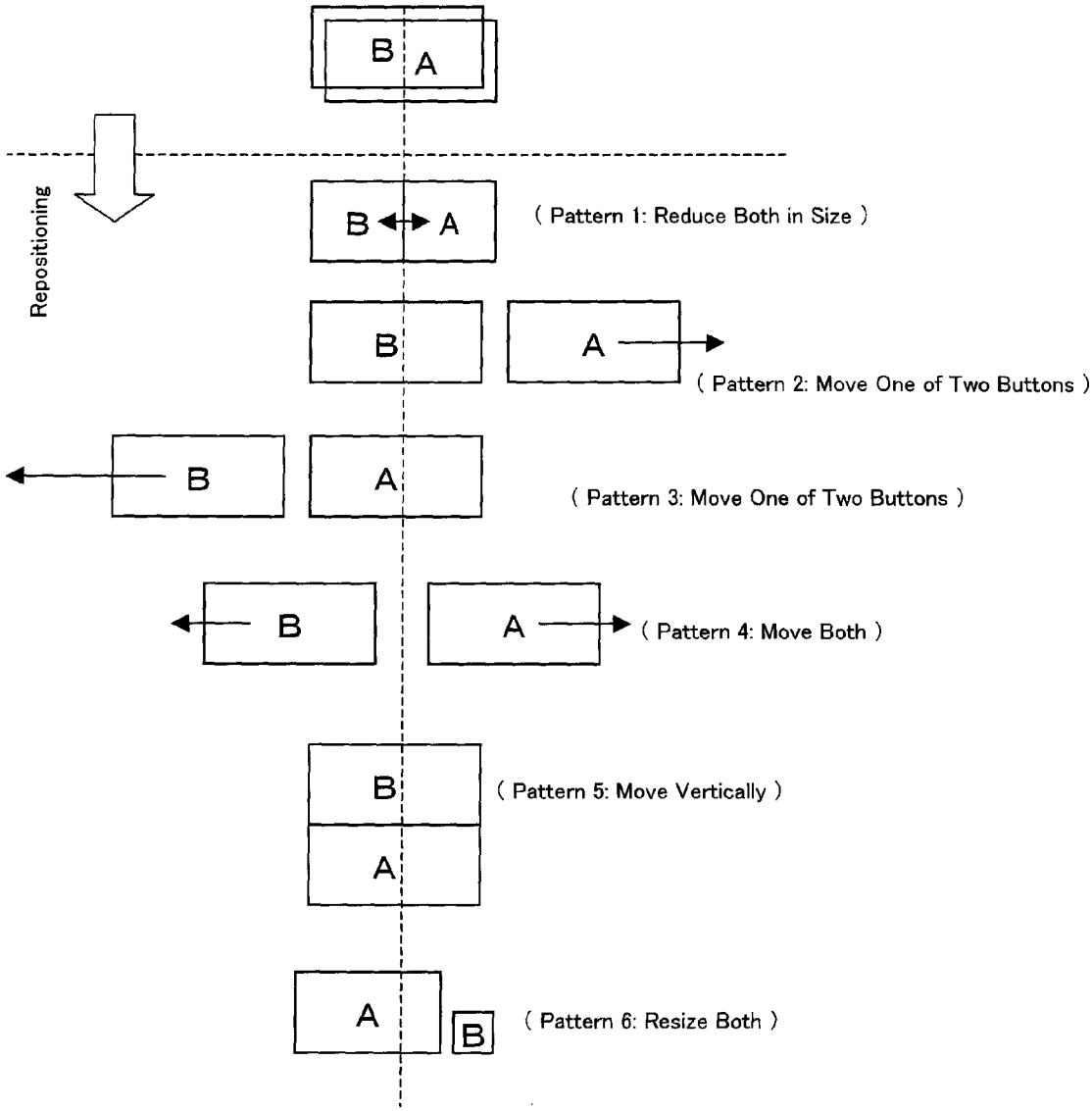
FIG. 7 is an illustration of variations of repositioning.

FIG. 7 shows variations of image repositioning. The input button may be resized as in patterns 1, 6 or moved horizontally or vertically as in patterns 2 to 5.

The positions of input buttons may be pre-fixed for each application (that is, regardless of whether the display image is viewed from the right or from the left) so that no input buttons belonging to different applications appear at the same position. For example, supposing that two applications a, b are installed in one multiplex image display device, application a may provide input buttons stacked vertically to the right, whilst application b may provide input buttons stacked vertically to the left. Taking an in-vehicle display device as an example, the device should not display television broadcast (a kind of application) for the driver while the driver is at the wheel, whereas it needs to display engine conditions and other necessary information for driving to the assistant driver. In that situation, either the positioning control section 16 or the GUI preferably fixes input button positions for individual applications. For example, by entering, on the operation section 11, information that the steering wheel is mounted to the right-hand side of the car, the engine conditions display application can provide input buttons stacked vertically to the right, and the television broadcast display application can provide input buttons stacked vertically to the left.

Next will be described the pre-adjusting of command area positions, another configuration which prevents the command areas from appearing at the same positions.

Each onscreen area that can be allocated as a command area is registered for one of applications in advance.

As shown in FIG. 8, some rows starting from the top of the display screen are allocated as command areas for image A. The remaining rows are allocated as command areas for image B. For example, the top half of the display screen may be allocated for image A, and the bottom half for image B.

An alternative is shown in FIG. 9 where alternate columns of the display screen are allocated for image A, and the rest for image B.

A further alternative is in FIG. 10 where command areas for image A and those for image B form a lattice in the display screen.

Another alternative is shown in FIG. 11 where the periphery of the display screen is allocated for image A, and the center for image B.

Other alternatives are also possible.

As the user selects applications on the operation section 11 for a dual view display, the image A receiving section 12 and the image B receiving section 14 receive two images from the applications before using the applications. The positioning control section 16 performs positioning of the input buttons for the images according to one of prescribed schemes (FIGS. 8 to 11 show examples of the schemes). The image A control section 13 and the image B control section 15 produce data for the images with repositioned input buttons according to positioning instructions. The image combining section 18 combines the two images according to a publicly known method specified for the double image display device. The display section 19 displays the combined image.

The car navigation application requires large input button areas because it inherently uses onscreen maps which at the same time act as input buttons. In a configuration where different areas are allocated in advance for input buttons on the right-hand image and those on the left-hand image, if the car navigation application is given large areas for its input buttons as it requires, the other application may not be given a sufficient area. Likewise, if areas are allocated according to the need of the other application, the car navigation application may not be given a sufficient area. The problem is addressed by the following approach.

Each application (including a car navigation application displayed for both the right-side viewing and the left-side viewing) normally designates portions of the display image as input buttons (this is "partial area input mode").

If the user wants to allocate the whole map image as input areas for the car navigation application, the user switches the display to a location input (destination input) screen by pressing an input button displayed by the car navigation application for that purpose (the result is "whole area input mode"). If the input button is pressed, the double image display device switches to a whole area input mode, displaying a map for a destination input by the user and allocating the whole display area as a command area for that application (map). The device displays no input buttons for the other (opposite) application, prohibiting any inputs at all, until the device switches back from whole area input mode. All these device actions take place under the control of the positioning control section 16.

If a location input is completed in the car navigation application, that is, an input is made on a map as required by the application, a command is entered to switch from an map input to a non-map screen of the car navigation application, a command is entered to quit the car navigation application, or no input is made for a predetermined period of time (for example, 30 seconds) (time out), the device switches back to the partial area input mode from the whole area input mode, displaying ordinary input buttons for any image that requires a command area to accept inputs. All these device actions take place under the control of the positioning control section 16.

Next will be described the specifying of command area positions every time a request is made by an application.

Figures 12, 13, 14, 15:
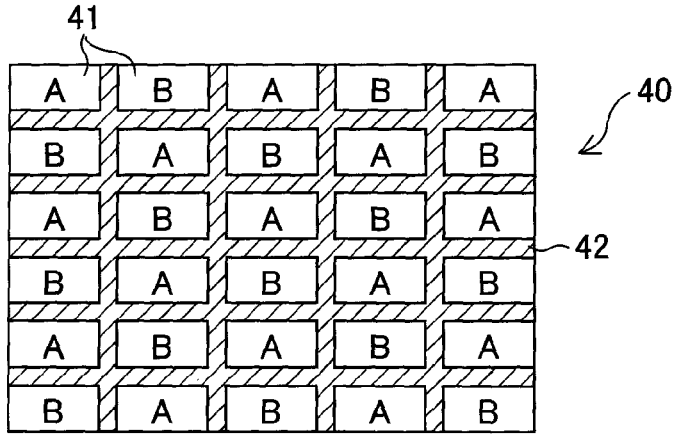
FIG. 12 is an illustration of an example of registration of areas for image displays.
FIG. 13 is an illustration of an example of registration of areas for image displays.
FIG. 14 is an illustration of an example of allocation and registration of areas for image displays.
FIG. 15 is an illustration of an example of a display which includes non-input areas.
Figure 16:
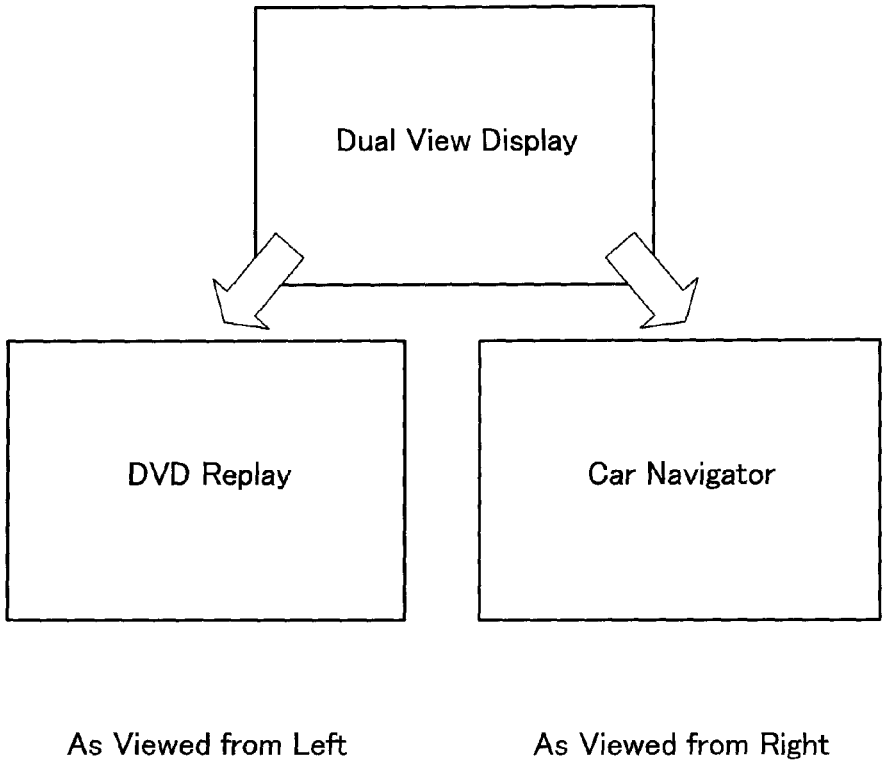
FIG. 16 is an illustration of how displays on a dual view LCD (conventional multiplex image display device) appear to viewers.
Figure 17:
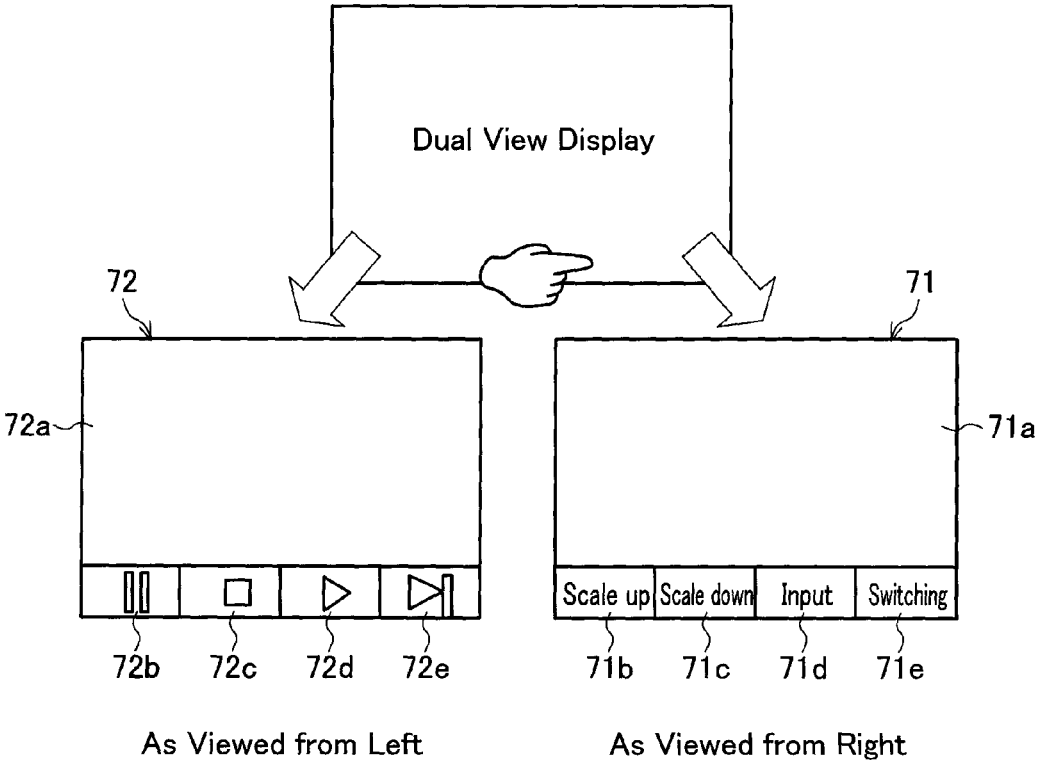
FIG. 17 is an illustration of how displays on a dual view LCD (conventional multiplex image display device) appear to viewers.

If either the user or the application which is currently running to provide image A makes a request to have an upper area of the display screen allocated as a command area as shown in FIG. 12, the area is allocated (registered) as a command area for image A. After the allocation, if either the user or the application which is currently running to provide image B makes a request to have a lower or any other area of the display screen allocated as a command area, for example, a lower portion of the display screen, which is however not the command area for image A, that is, a non-registered area, is allocated (registered) as a command area for image B.

Other approaches are also possible.

As the user selects applications on the operation section 11 for a dual view display, one of the two image receiving sections (image A receiving section 12 in FIG. 12) receives image A from the associated application, and the positioning control section 16 allocates input button positions for that image as shown in the example of FIG. 12. The image A control section 13 produces data for the image with repositioned input buttons according to positioning instructions. The image combining section 18 combines the two images according to a publicly known method specified for the double image display device. The display section 19 displays the combined image.

Thereafter, the other image receiving section (image B receiving section 14 in FIG. 12) receives image B from the associated application, and the positioning control section 16 allocates input button positions for that image as shown in example of FIG. 12. The image B control section 15 produces data for the image with repositioned input buttons according to positioning instructions. The image combining section 18 combines the two images according to a publicly known method specified for the double image display device. The display section 19 displays the combined image.

Next will be described two approaches being implemented together: the pre-adjusting of command area positions to prevent the command areas from appearing at the same positions and the specifying of command area positions every time a request is made by an application.

Similarly to the configuration in FIGS. 8 to 11, command areas for image A and those for image B are pre-determined as shown in FIG. 14. In this example, the upper and lower portions of the screen are allocated for the two images. A difference from the configuration in FIGS. 8 to 11 lies where not every onscreen area available as a command area is pre-registered as a command area for either of the applications. Only some of the available onscreen areas are pre-registered for either of the applications. The rest (two rows in the middle in the example of FIG. 14) are common areas and at first do not belong to any of the applications. All or some of the common areas are selectively allocated by the positioning control section as command areas for either application of image A or B if the positioning control section receives a request for additional command areas from the application, for example, when the pre-registered command areas are not sufficient.

In either of the above configurations, it is preferable to provide spacings (non-input area) between command areas. With spacings being provided, the user will less likely press wrong buttons, which results in fewer input errors. FIG. 15 shows such an example. A display screen 40 is divided into input areas (command areas) 41 and non-input areas (spacings between the command areas) 42. The non-input areas 42 are not used for user inputs. The non-input areas 42 stretch both from top to bottom and from left to right at intervals on the display screen 40. The areas surrounded by the stretches are designated as the input areas 41. The main image may be shown in the non-input areas 42. Also, nothing may be shown in the non-input areas 42. It is preferable to provide the non-input areas 42 in one, different color from the input areas 41, so that the user is less likely to press wrong buttons.

The present invention being thus described with respect to preferred embodiments thereof, it should be noted that the same way may be varied in many ways. Such variations are not to be regarded as a departure from the spirit and scope of the present invention, and all such modifications as would be recognized by one skilled in the art are intended to be included within the scope of the following claims.

The members of the multiplex image display device and the process steps illustrated in the above-described preferred embodiments are preferably realized by a CPU or other computing device executing computer programs contained in a ROM (Read-Only Memory), a RAM, or other storage device so as to control a keyboard or other input devices, a display device or other output devices, or an interface circuit or other communications devices. Therefore, the various functions and various processes of the multiplex image display device of the present preferred embodiments are realized by merely a computer, which is equipped with these devices, reading a storage medium containing the programs and executing them. In addition, a removable storage medium containing the programs makes it possible to execute the various functions and processes on any computer.

The computer program storage medium may be a memory (not shown), such as a ROM, so that the process is executable on a microcomputer. Alternatively, a program medium may be used which is readable when loaded into an external storage device (program reader device; not shown).

In addition, in any case, it is preferable if the contained programs are accessible to a microprocessor for execution. Furthermore, it is preferable if the programs are read and then downloaded to a program storage area in a microcomputer where the programs are executed. Assume that the programs to be downloaded are stored a main device in advance.

In addition, the program medium is a storage medium adapted so that it is separable from the main body. Examples of such a program medium include tapes, such as magnetic tapes and cassette tapes; magnetic disks, such as flexible disks and hard disks; optical discs, such as CDs, MOs, MDs, and DVDs; cards, such as IC cards (inclusive of memory cards); and semiconductor memories, such as mask ROMs, EPROMs (erasable programmable read-only memories), EEPROMs (electrically erasable programmable read-only memories), and flash ROMs. All these storage media contain computer programs in a fixed manner.

Alternatively, if a system can be constructed which can connect to the Internet or other communications network, it is preferable if the program medium is a storage medium carrying the programs in a flowing manner so that the programs can be downloaded over the communications network.

Furthermore, when the programs are downloaded over a communications network in this manner, it is preferable if a program for the download is stored in a main device in advance or installed from another storage medium.

The multiplex image display device in accordance with various preferred embodiments of the present invention may be configured to display onscreen input buttons for the touch panel so that the buttons do not overlap on left/right screens.

The multiplex image display device in accordance with various preferred embodiments of the present invention may, in the above configuration, be configured to predetermine areas in the right-hand image and in the left-hand image where the input buttons are allowed to appear so that none of the areas overlap.

The multiplex image display device in accordance with various preferred embodiments of the present invention may, in the above configuration, be configured to register those input button areas which are already being used for input buttons to display input buttons at positions where the other screen is not using.

The multiplex image display device in accordance with various preferred embodiments of the present invention may, in the above configuration, be configured to be combination of the second and third configurations.

The multiplex image display device in accordance with various preferred embodiments of the present invention may be a multiplex image display device with onscreen input function capable of displaying different images for different viewing points. The device may include: a comparison/detection section arranged to compare and detect overlapping of onscreen input positions for the onscreen input function provided onscreen and onscreen input positions for another image; and a repositioning control section arranged to reposition at least the onscreen input positions. If there are overlapping onscreen input areas, at least onscreen input positions are repositioned to produce a display.

Being configured as described above, the device is capable of providing a plurality of users of the multiplex image display device with onscreen input function with visual input devices (e.g., onscreen input device) in accordance with individual users' images. The onscreen input function is a function of touch sensors and touch panels which are input devices detecting a contact position with a finger or a stylus. In particular, when the multiplex image display device is installed as an in-vehicle display device, the function enables, for example, a car navigation screen with a touch panel for the driver and operation screens for an AV system, an air conditioner, and various other information devices for the assistant driver.

Being configured as described above, the device is capable of providing visual input devices for individual images using a single touch panel, with no additional dedicated hardware, for more than one user of the multiplex image display device with onscreen input function.

As described in the foregoing, the multiplex image display device in accordance with various preferred embodiments of the present invention is preferably configured as follows. Before the images are displayed, the positioning control section allocates a command area to each application which is software providing one of the images for display on the display screen. The command areas are allocated so as to be displayed at different positions.

Being configured as described above, the device is capable of allocating command areas to the applications in advance so that the command areas are displayed at different positions for the individual images being simultaneously displayed on the single display screen. The configuration omits a process of temporarily determining the positions of command areas and if they overlap, adjusting the positions so that they do not overlap. Therefore, the configuration is simpler than the previously mentioned configurations, but still achieving the same effects as the previous ones and additionally enabling the device to distinguish between command areas.

The multiplex image display device in accordance with various preferred embodiments of the present invention may, in the above configuration, be preferably configured as follows. The positioning control section allocates an area as a command area for one of the images in response to a request for a command area by an application which is software providing that image for display on the display screen. The section also allocates a non-allocated area as a command area for another one of the images in response to a request for a command area by an application which is software providing the other image for display on the display screen.

Being configured as described above, the device is capable of allocating, in response to a request for a command area by an application, an area as a command area for the associated one of the images being simultaneously displayed on the single display section. The device is also capable of allocating a non-allocated area as a command area for another one of the images in response to a request for a command area by the associated application. Therefore, any of the applications providing images for simultaneous display can secure sufficient command areas for it by increasing them if no other applications are using the areas. Therefore, the configuration achieves the same effects as the previous ones and additionally enables the device to be flexible in handling various applications which need many command areas.

The multiplex image display device in accordance with various preferred embodiments of the present invention may, in the above configuration, be preferably configured as follows. Before the images are displayed, the positioning control section allocates a command area to each application which is software providing one of the images for display on the display screen. The command areas are allocated so as to be displayed at different positions. In response to a request for another command area by one of the applications, the positioning control section allocates a non-allocated area as a command area for the image provided by that application.

Being configured as described above, the device is capable of, before simultaneously displaying the images on the single display screen, allocating a command area to each application so that the command areas are displayed at different positions. In response to a request for another command area by one of the applications providing one of the images being simultaneously displayed on the single display screen, the device is also capable of allocating a non-allocated area as a command area for the image provided by that application. The configuration omits a process of temporarily determining the positions of command areas and if they overlap, adjusting the positions so that they do not overlap. Any of the applications providing images for simultaneous display can secure sufficient command areas for it by increasing them if no other applications are using the areas. Therefore, the configuration is simpler than the previously mentioned configurations, but still achieving the same effects as the previous ones and additionally enabling the device to distinguish between command areas. Also, the configuration enables the device to be flexible in handling various applications which need many command areas.

The multiplex image display device in accordance with various preferred embodiments of the present invention may, in the above configuration, be preferably configured as follows. The positioning control section temporarily determines the positioning of the command areas for the images, and if the command areas overlap, adjusts the positioning so that the command areas do not overlap.

Being configured as described above, the device is capable of temporarily determining the positioning of the command areas for the images being simultaneously displayed on the single display screen. If the command areas overlap, the device is also capable of adjusting the positioning so that the command areas do not overlap. The configuration omits a process of predetermining non-overlapping command areas and a process of increasing command area allocation if the predetermined command areas are not sufficiently. Therefore, the configuration achieves the same effects as the previous ones and additionally enables the device to flexible in handling various applications which need many command areas of many different kinds.

The multiplex image display device in accordance with various preferred embodiments of the present invention may, in the above configuration, be preferably configured as follows. In response to a request by an application which is software providing one of the images, i.e., image A, for display on the display screen that the display screen be entirely allocated as a command area for image A, the positioning control section allocates the display screen entirely as a command area for image A. Even if an application which is software providing another one of the images being displayed simultaneously with image A makes a request that the display screen be partly allocated as a command area for the other image, the positioning control section does not display that command area.

Being configured as described above, the device is capable of allocating the display screen entirely as a command area for image A, one of the images being simultaneously displayed on the single display screen, in response to a request by an application for image A that the display screen be entirely allocated as a command area for image A. Even if an application for another one of the images being displayed simultaneously with image A makes a request that the display screen be partly allocated as a command area, the device does not display that command area. Thus, while the display screen is being entirely allocated as a command area for image A, the device prevents irrelevant inputs from being made on the other image, which could otherwise be unintentionally translated as a legitimate input for image A. Therefore, the configuration achieves the same effects as the previous ones and additionally enables the device to be flexible in handling an application which needs to have the display screen be entirely allocated as its command area.

The multiplex image display device in accordance with various preferred embodiments of the present invention may, in the above configuration, be preferably configured as follows. While the display screen is being entirely allocated as a command area for image A, the positioning control section determines whether the user has entered a sufficient command in the command area to stop allocating the display screen entirely as the command area for image A. Upon determining that the user has entered such a command, the positioning control section stops allocating the display screen entirely as the command area for image A. The positioning control section displays a command area for another one of the images being displayed simultaneously with image A in response to a request for that command area by the application which is software providing the other image.

While the display screen is entirely being allocated as the command area for image A, the device, configured as above, is capable of stopping allocating the display screen entirely as the command area for image A if the user has entered a sufficient command in the command area to stop allocating the display screen entirely as the command area for image A. Also, the device displays a command area for another one of the images being displayed simultaneously with image A in response to a request for that command area by the application which is software providing the other image.

For a car navigation program, for example, the entire display screen is allocated as the command area for a map to receive a destination input.

Examples of the sufficient command to stop allocating the display screen entirely as the command area for image A include inputs made in response to a request by the application and commands to quit such input mode. In the case of a car navigation program, for example, the former is, for example, a destination input on the map, and the latter is, for example, commands to quit map inputs and switch to a screen other than the map within the car navigation program and to quit the car navigation program itself.

Therefore, if image A no longer needs the entire display screen as its command area, the prohibition of the display of command areas for the other images is lifted, and inputs in those command areas are accepted. Therefore, the configuration achieves the same effects as the previous ones and additionally enables the device to run an application that requires the entire display screen as its command area without seriously sacrificing the user operability of the other various applications.

The multiplex image display device in accordance with various preferred embodiments of the present invention may, in the above configuration, be preferably configured as follows. While the display screen is being entirely allocated as a command area for image A, the positioning control section determines whether the user has entered a sufficient command in the command area to stop allocating the display screen entirely as the command area for image A within a predetermined period of time. Upon determining that the user has not entered such a command within the period, the positioning control section stops allocating the display screen entirely as the command area for image A. The positioning control section displays a command area for another one of the images being displayed simultaneously with image A in response to a request for that command area by the application which is software providing the other image.

While the display screen is entirely being allocated as the command area for image A, the device, configured as above, is capable of stopping allocating the display screen entirely as the command area for image A if the user has not entered a sufficient command in the command area to stop allocating the display screen entirely as the command area for image A within a predetermined period of time. Also, the device displays a command area for another one of the images being displayed simultaneously with image A in response to a request for that command area by the application which is software providing the other image. Therefore, even if image A needs the entire display screen as its command area for an extended period of time, a prolonged prohibition of the display of command areas for the other images is effectively prevented. Therefore, the configuration achieves the same effects as the previous ones and additionally enables the device to run an application that requires the entire display screen as its command area without seriously sacrificing the user operability of the other various applications.

The computer program for multiplex image display in accordance with another preferred embodiment of the present invention is characterized in that it causes a computer to function as the positioning control section in one of the multiplex image display devices described above.

The computer-readable storage medium containing the computer program in accordance with a further preferred embodiment of the present invention is characterized in that it contains the multiplex image display program.

The various preferred embodiments and examples described above are for illustrative purposes only and by no means limit the scope of the present invention. Variations are not to be regarded as a departure from the spirit and scope of the invention, and all such modifications as would be recognized by one skilled in the art are intended to be included within the scope of the claims below.

The present invention is also applicable to multiplex image displays and like devices which display different images for individual viewing points.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A multiplex image display device arranged to simultaneously display a plurality of images on a single display screen to provide individual viewing from different directions, said device comprising:

a display section including the single display screen; and a positioning control section arranged to control positioning of onscreen command areas where a user can enter a command for manipulating one of the plurality of images, the positioning control section being arranged to control positioning such that when a command area for one of the plurality of images is displayed simultaneously with a command area for another one of the plurality of images, the command areas are displayed at different positions on the single display screen; wherein the plurality of images includes a first image displayed to be viewable from a first direction and a second image displayed to be viewable from a second direction which differs from the first direction;

the command areas are displayed as images separate from the plurality of images;

the command areas include a first command area for the first image that is displayed to be viewable from only the first direction and a second command area for the second image that is displayed to be viewable from only the second direction; and the positioning control section is arranged to determine a relative position of the first command area and a relative position of the second command area, so that the relative position of the first command area with respect to the first image is different from the relative position of the second command area with respect to the second image such that no portions of the first command area and the second command area will ever overlap.

2. The multiplex image display device of claim 1, wherein before the plurality of images are displayed, the positioning control section allocates a command area to each application which is software providing one of the plurality of images for display on the display screen.

3. The multiplex image display device of claim 1, wherein the positioning control section allocates an area as a command area for one of the plurality of images in response to a request for a command area by an application which is software providing said one of the plurality of images for display on the display screen, and a non-allocated area as a command area for another one of the plurality of images in response to a request for a command area by an application which is software providing said another one of said plurality of images for display on the display screen.

4. The multiplex image display device of claim 1, wherein before the images are displayed, the positioning control section allocates a command area to each application which is software providing one of the plurality of images for display on the display screen, and in response to a request for another command area by one of the applications, allocates a non-allocated area as a command area for the image provided by that application.

5. The multiplex image display device of claim 1, wherein the positioning control section temporarily determines the positioning of the first and second command areas, and if the first and second command areas overlap, adjusts the positioning so that the first and second command areas do not overlap.

6. The multiplex image display device of claim 1, wherein in response to a request by an application which is software providing one of the plurality of images defining image A for display on the display screen, that the display screen be entirely allocated as a command area for image A, the positioning control section allocates the display screen entirely as a command area for image A, and even if an application which is software providing another one of the plurality of images being displayed simultaneously with image A makes a request that the display screen be partly allocated as a command area for the other image, does not display that command area.

7. The multiplex image display device of claim 6, wherein the positioning control section operates such that while the display screen is being entirely allocated as a command area for image A, the positioning control section determines whether the user has entered a sufficient command in the command area to stop allocating the display screen entirely as the command area for image A, upon determining that the user has entered such a command, the positioning control section stops allocating the display screen entirely as the command area for image A, and the positioning control section displays a command area for another one of the plurality of images being displayed simultaneously with image A in response to a request for that command area by the application which is software providing the other image.

8. The multiplex image display device of claim 7, wherein the positioning control section operates such that while the display screen is being entirely allocated as a command area for image A, the positioning control section determines whether the user has entered a sufficient command in the command area to stop allocating the display screen entirely as the command area for image A within a predetermined period of time, upon determining that the user has not entered such a command within the period, the positioning control section stops allocating the display screen entirely as the command area for image A, and the positioning control section displays a command area for another one of the images being displayed simultaneously with image A in response to a request for that command area by the application which is software providing the other image.

9. A tangible computer-readable storage medium containing a computer program for multiplex image display, causing a computer to function as the positioning control section in the multiplex image display device of claim 1.

10. The multiplex image display device of claim 1, wherein the positioning control section is arranged to:

allocate, in advance, onscreen areas available as command areas to a first application which provides one of the images to be displayed on the single display screen;

allocate, in advance, other onscreen areas to a second application which also provides one of the images to be displayed on the single display screen, the second application being different from the first application;

specify areas that are not allocated to either of the first application and the second application as common command areas usable by either of the first application and the second application; and upon receiving a request for additional command areas from either one of the first application and the second application, allocate at least some of the common command areas as command areas for the requesting one of the first application and the second application.

* * * * *